US006003182A

United States Patent [19]

Song

[11] Patent Number: 6,003,182

[45] Date of Patent: Dec. 21, 1999

[54] METHOD FOR MAINTAINING SET TEMPERATURE OF WASH WATER OF CLOTHES WASHER

[75] Inventor: Bok-Nam Song, Incheon, Rep. of Korea

[73] Assignee: Daewoo Electronics Co., Ltd., Seoul, Rep. of Korea

[21] Appl. No.: 09/093,935

[22] Filed: Jun. 9, 1998

[30] Foreign Application Priority Data

Jun. 11, 1997 [KR] Rep. of Korea ..... 97-23993

[51] Int. Cl.[6] ..... D06F 39/08

[52] U.S. Cl. ..... 8/158; 68/12.03; 68/12.05; 68/12.21; 68/12.22; 68/207; 236/12.12

[58] Field of Search ..... 8/158; 68/12.03, 68/12.05, 12.21, 12.22, 207; 236/12.12

[56] References Cited

U.S. PATENT DOCUMENTS 4,406,401 9/1983 Nettro ..... 68/12.22 X
4,528,709 7/1985 Getz et al. ..... 68/12.22 X
5,439,019 8/1995 Quandt et al. ..... 68/12.22 X

*Primary Examiner*—Philip R. Coe
*Attorney, Agent, or Firm*—Jacobson, Price, Holman & Stern, PLLC

[57] ABSTRACT

A method for maintaining a set temperature of wash water of clothes washer comprises the steps of supplying first cold water into a wash tub, measuring supply time of the first cold water until filling a first target level of the first cold water, measuring temperature of the cold water contained in the wash tub, supplying hot water and second cold water in the wash tub containing the first cold water, measuring supply time of the hot water and the second cold water until filling a second target level of the hot water and the second cold water, measuring temperature of mixed water being comprised of the hot water and the first and second cold water contained in the wash tub, and comparing temperature of the hot water which is calculated on the following four values-supply time of the first cold water, temperature of the first cold water, supply time of the hot water and the second cold water, and temperature of the mixed water with predetermined temperature, and controlling a valve for the cold water and a valve for the hot water.

7 Claims, 4 Drawing Sheets

METHOD FOR MAINTAINING SET TEMPERATURE OF WASH WATER OF CLOTHES WASHER

BACKGROUND OF THE INVENTION

1. Field of the Invention

The present invention relates to a method for maintaining a set temperature of wash water of clothes washer. More particularly, the present invention relates to a method for maintaining a set temperature of wash water of clothes washer in which cold water is supplied at the onset and then cold water and hot water having proper temperature are supplied until a predetermined level.

2. Description of the Prior Art

Clothes washer provided with typical control system is shown in FIG. 3. The washer is comprised of a water supplier 12 providing valves 12*a*, 12*b* for supplying hot water and cold water into a wash tub 17, a temperature detector 15 for sensing temperature of mixed water supplied from the hot valve 12*a* and the cold valve 12*b*, a temperature controller 14 for controlling the opening or closing of each valve according to the sensed temperature by the temperature detector 15, and a micro-computer 13 for controlling functions of the above mentioned elements.

At the onset of a water supply mode, the temperature controller 14 enables the hot and cold water valves 12*a*, 12*b* to open under a command of the microcomputer 13, and the hot water and the cold water flow into the wash tub 17. Thereafter, the temperature of mixed water comprised of the hot and cold water is detected by the temperature detector 15, and then the detected value is sent to the temperature controller 14. Further, the water supplier 12 is controlled to obtain a target temperature of the mixed water so the washing water having a desired temperature flows into the wash tub 17.

In the clothes washer providing the control system, excessive hot water unexpectedly flows into the wash tub 17 through the hot valve 12*a*, which leads to problem that the clothes contained in the wash tub 17 seem to be badly damaged. Further, the temperature of the mixed water comprised of hot water and cold water is sensed at a portion located after the supply area, that is, the portion before the hot water and the cold water are sufficiently mixed, which causes an inaccurate temperature of the mixed water.

SUMMARY OF THE INVENTION

Therefore, it is an object of the present invention to provide a method for maintaining a set temperature of wash water of clothes washer for solving the above problems.

It is another object of the present invention to provide a method for maintaining a set temperature of wash water of clothes washer by which clothes can avoid being damaged by the hot water unexpectedly flowing into the wash tub.

It is another object of the present invention to provide a method for maintaining a set temperature of wash water of clothes washer by which the temperature of the mixed water can be measured accurately.

In order to achieve the above objects of the present invention in a method for maintaining a set temperature of wash water of clothes washer, the method comprises the steps of supplying first cold water into a wash tub, measuring supply time of the first cold water until filling a first target level of the first cold water, measuring temperature of the cold water contained in the wash tub, supplying hot water and second cold water in the wash tub containing the first cold water, measuring supply time of the hot water and the second cold water until filling a second target level of the hot water and the second cold water, measuring temperature of mixed water being comprised of the hot water and the first and second cold water contained in the wash tub, and comparing temperature of the hot water which is calculated on the following four values-supply time of the first cold water, temperature of the first cold water, supply time of the hot water and the second cold water, and temperature of the mixing water with a predetermined temperature, and controlling a valve for the cold water and a valve for the hot water.

DESCRIPTION OF THE PREFERRED EMBODIMENT

Figure 1:
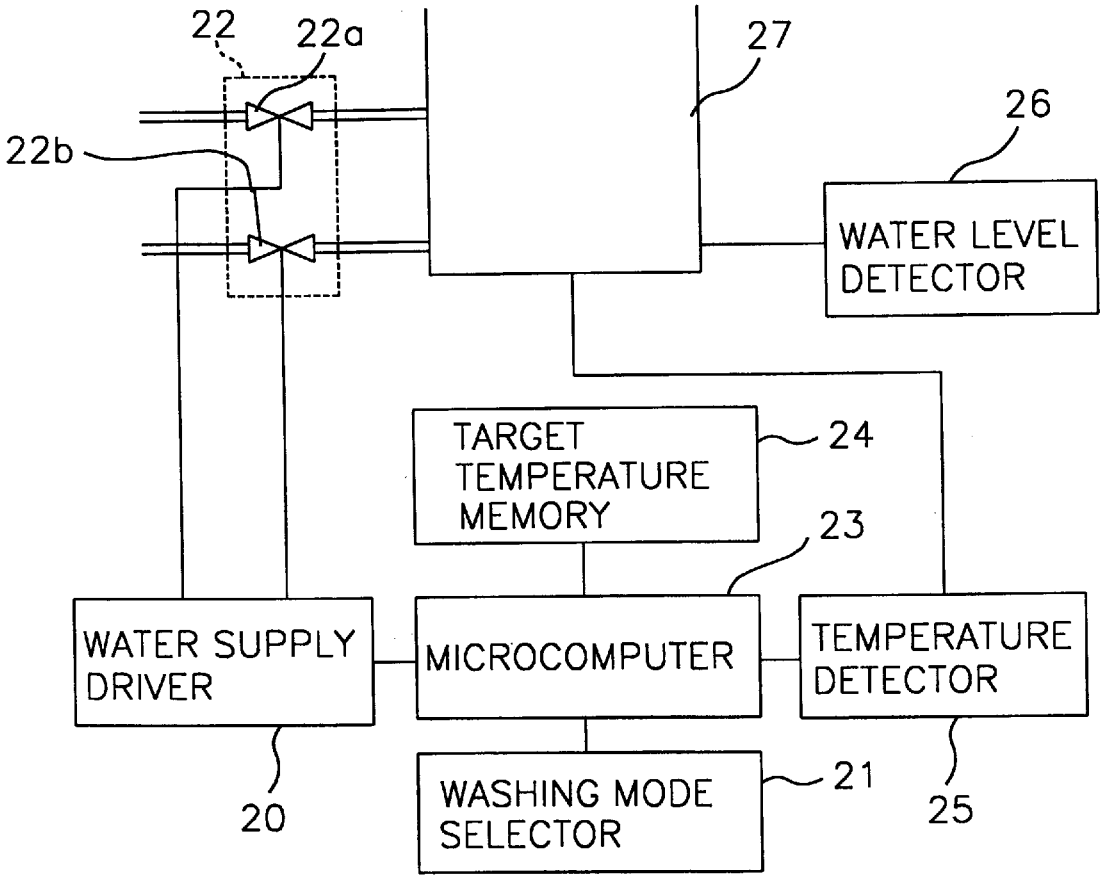
FIG. 1 is a block diagram schematically showing a clothes washer having a control system according to the present invention.

The present invention will be better clarified by describing a preferred embodiment thereof with reference to the above accompanying drawings. Clothes washer provided with control system in the present invention is shown in FIG. 1. The washer is comprised of a water supplier 22 providing valves 22*a*, 22*b* for supplying hot water and cold water into a wash tub 27, a water supply driver 20 for controlling the opening or closing of each valve 22*a*, 22*b*, a water level detector 26 for sensing the level of water supplied into the wash tub 27, a temperature detector 25 for sensing temperature of the water supplied into the wash tub 27, a target temperature memory 24, a microcomputer 23 for controlling the function of the clothes washer, and a washing mode selector 21 for enabling the data inputted by a user to be sent to the microcomputer 23.

Figure 2A:
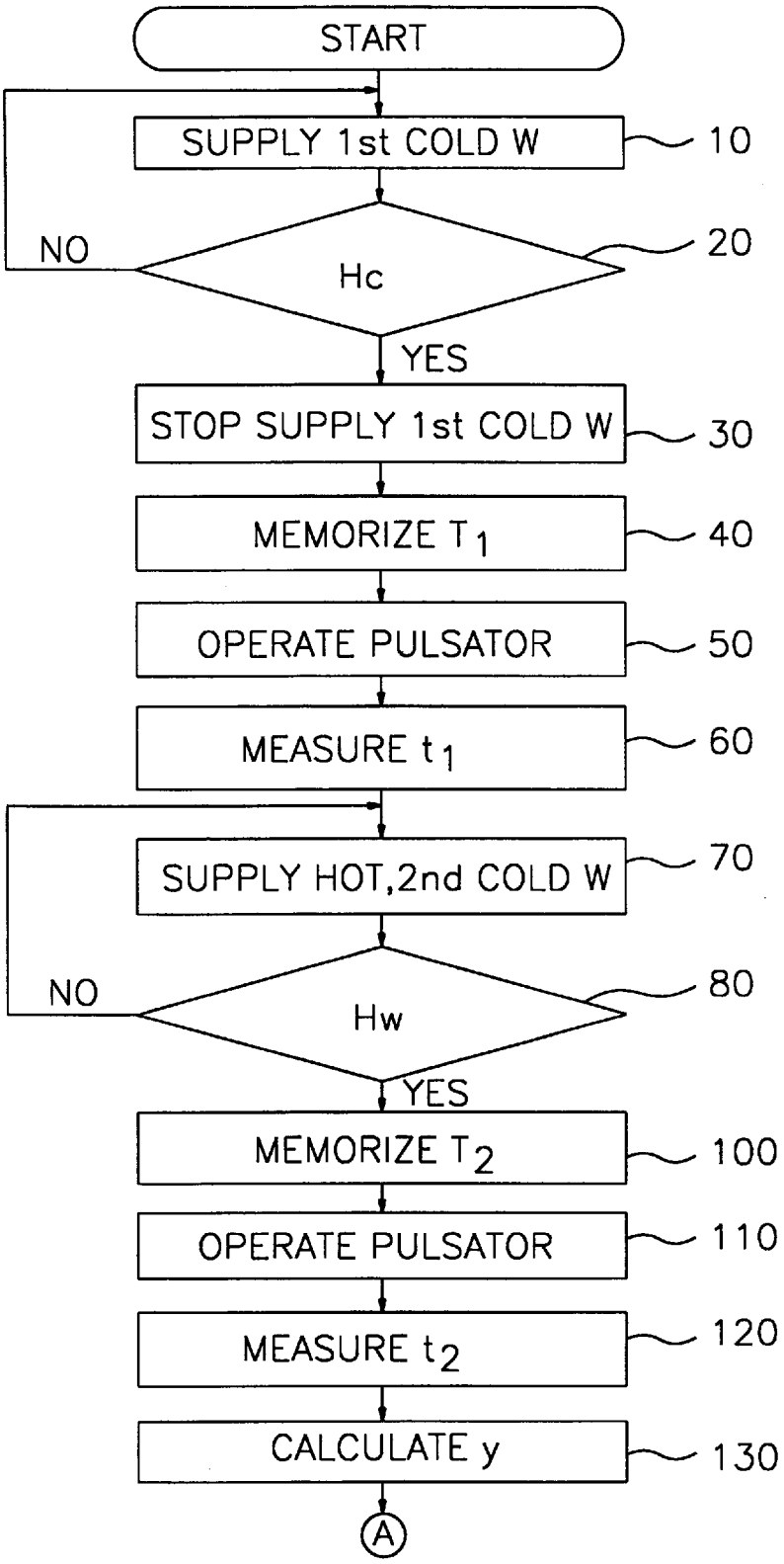
FIGS. 2A and 2B are a flowchart showing operational steps for maintaining a set temperature of wash water of clothes washer according to the present invention.
Figure 2B:
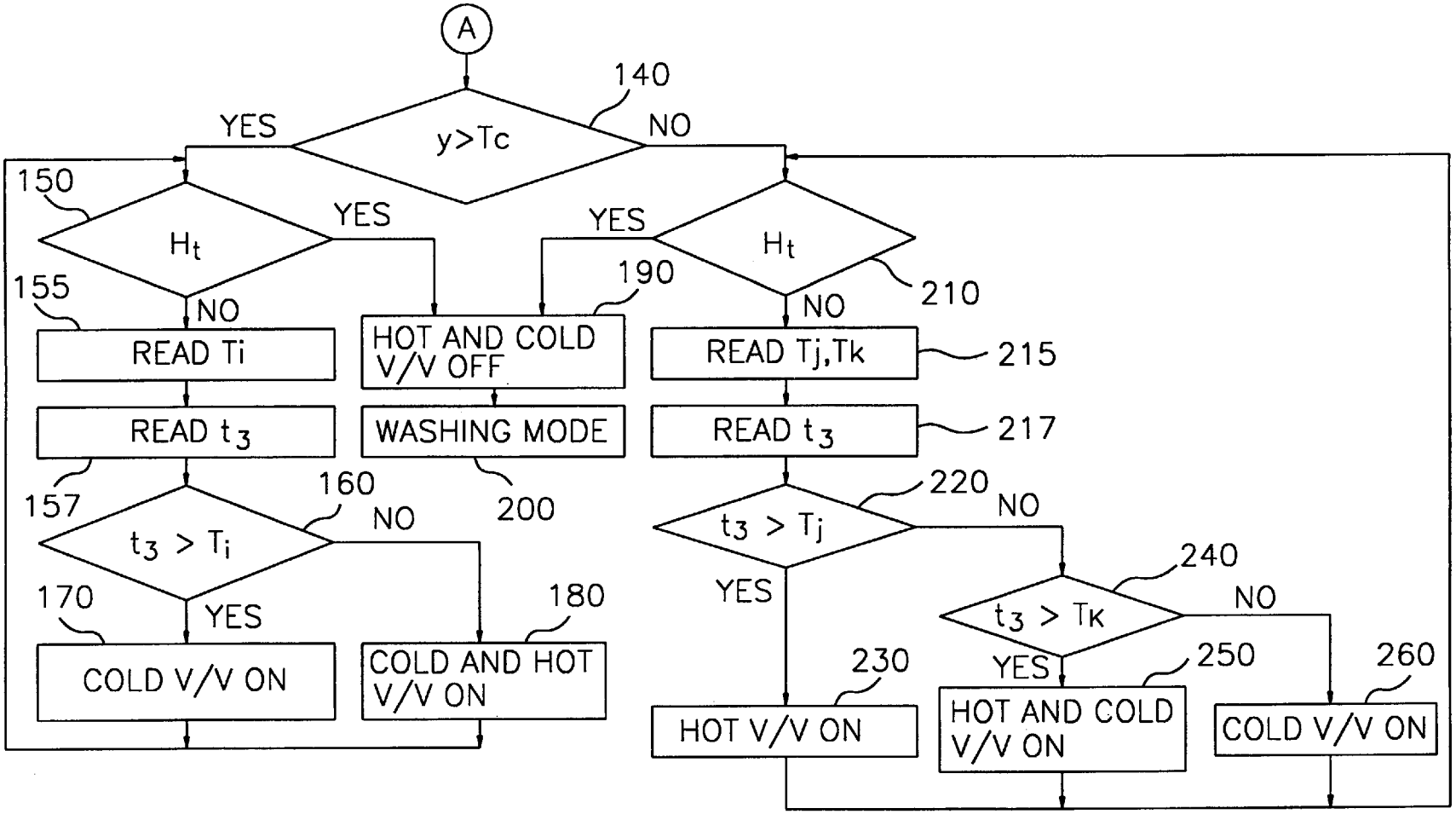
Figure 3:
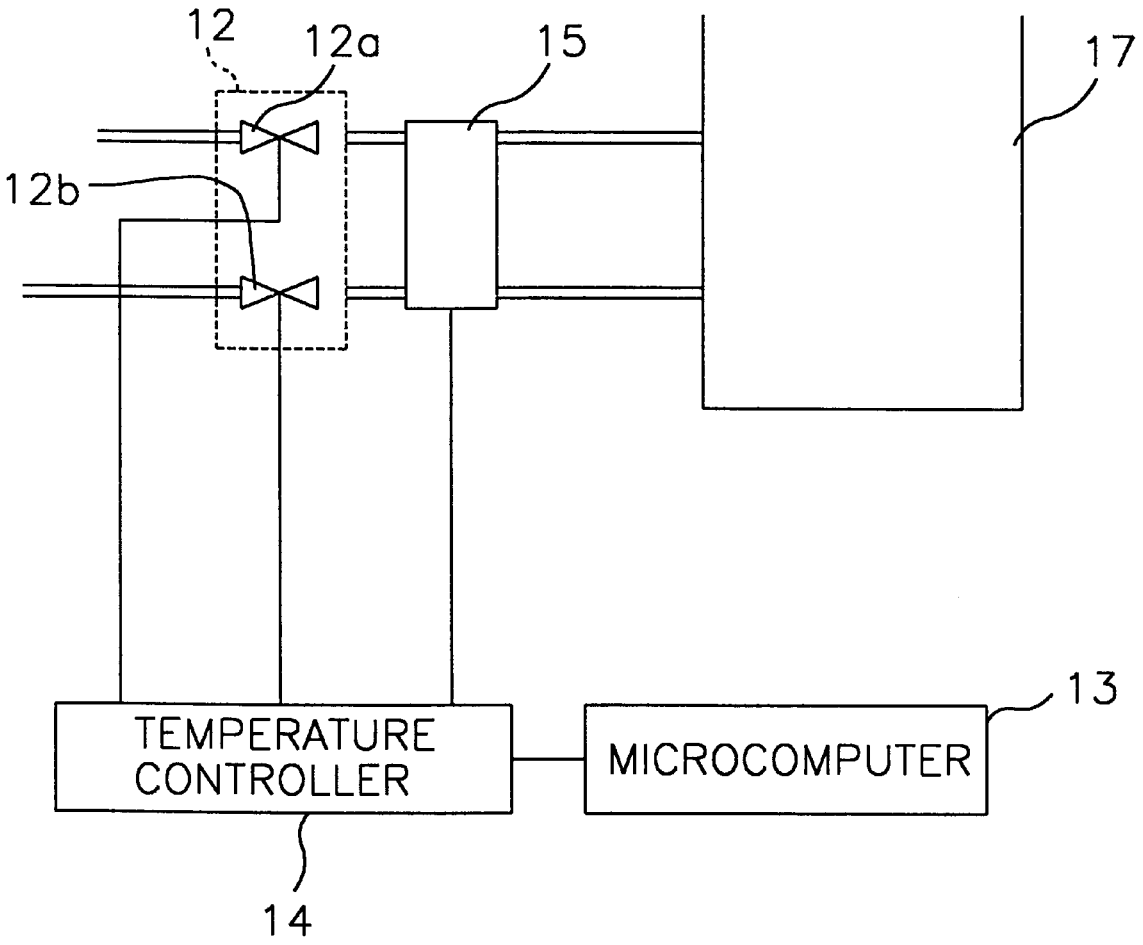
FIG. 3 PRIOR ART
FIG. 3 is a block diagram schematically showing a clothes washer having a control system according to a prior art.

FIGS. 2A and 2B are a flow chart diagram of the steps followed by the control system of the present invention. In a control block 10 the user selects the water supply mode at a washing mode selector 21, and the cold water is supplied into the wash tub 27 through the opened cold water valve 22*b*. Control passes to a control block 20 where an inquiry is made through the water level detector 26 to determine if a predetermined volume of a first cold water has reached a first target water level Hc. If the answer to the inquiry is negative, that is, volume of the first cold water has not filled to the first target level Hc, the control gives feedback to control block 10 in which the first cold water is supplied until the first target level Hc is reached. If the answer to the inquiry is affirmative, that is, the first cold water has reached the first target water level Hc, control is passed to control block 30 which closes the cold water valve 22*a* to stop the supply of the cold water.

Control is then passed to control block 40 in which a first cold water supply time T1 which is measured until the stoppage of the supply of the first cold water from the start of the supply of the first cold water is stored in the microcomputer 23. A pulsator (not shown) is rotated in a predetermined time period at control block 50. Control is then passed to control block 60 to store the temperature t1 of the first cold water contained in the wash tub 27 sensed through the temperature detector 25 in the microcomputer 23.

Control is passed to control block 70 where the hot water valve 22*a* and the cold water valve 22*b* are opened to supply a hot water and a second cold water into the wash tub 27 in which the first cold water already filled to the first target level. Control passes to control block 80 where an inquiry is made through the water level detector 26 to determine if a predetermined volume of a hot water and a second cold water has reached a second target water level Hw which is the same as the first target water level. If the answer to the inquiry is negative, that is, volume of the hot water and the second cold water has not filled to the second target level Hc, control feed-backs to control block 70 in which the hot water and the second cold water are supplied until the second target level Hw is reached. If the answer to the inquiry is affirmative, that is, the hot water and the second cold water have reached the second target water level Hw, control is passed to control block 100 in which the hot water and the second cold water supply time T2 which are measured until the stoppage of the supply of the hot water and the second cold water from the start of the supply of the hot water and the second cold water is stored in the microcomputer 23. A pulsator (not shown) is rotated in a predetermined time period at control block 110. Control is then passed to control block 120 to store the temperature t2 of the hot water and the first and second cold water contained in the wash tub 27 sensed through the temperature detector 25 in the microcomputer 23.

Control passes to control block 130 which calculates the temperature of the hot water by the following equations.

$$P1 = W / T1$$

$$P2 = W / T2 - P1$$

$$= W / T2 - W / T1$$

where, W is volume of wash water for reaching the first target level or the second target level P1 is pressure of cold water P2 is pressure of hot water T1 is supply time for first cold water T2 is supply time for hot water and second cold water $$Qcold=T1*P1+T2*P1$$

$$Qhot=T2*P2$$

where, Qcold is sum of volume of cold water in T1 and T2

Qhot is volume of hot water in T2

Finally, the temperature of hot water y is attained from the following equation with employing values represented by Qcold and Qhot.

$$t1*Ocold+y*Qhot=t2*(Qcold+Qhot)$$

where, t1 is the measured temperature of first cold water t2 is the measured temperature of mixed (hot, first and second cold) water Control is passed to control block 140 which compares temperature of the hot water y with the predetermined set high temperature Tc memorized in the microcomputer. In this embodiment the high temperature Tc is set as 80° C. If the comparison value is positive, control is passed to control block 150, whereas if the comparison value is negative, control is passed to control block 210.

In control block 150, an inquiry is made to determine if the water volume has inflowed until a third target level Ht is reached to enter the washing mode. If this volume has not yet reached the third water level Ht, control is passed to control block 155. The first target temperature Ti stored in the microcomputer 23 is read in control block 155. Control is then passed to control block 157. In this embodiment the first target temperature Ti is set as 36° C. A present temperature t3 of the mixed water contained in the wash tub 27 is read through the temperature detector 25 in control block 157, and control is then passed to control block 160.

In control block 160, the present temperature t3 of the mixed water is compared with the first target temperature Ti. If the comparison value is positive, control is passed to control block 170, and the water supply driver 20 is operated to open only the cold valve 22*b* and supply the cold water into the wash tub 27 continuously. On the contrary, if the comparison value is negative, control is passed to control block 180, and the hot water valve 22*a* and the cold valve 22*b* are opened and the hot and cold water are supplied into the wash tub 27 continuously. Control finished in either control block 170 or control block 180 is fedback to control block 150, respectively. If the water level contained in the wash tub 27 reaches the third target water level Ht, control is passed to control block 190 which operates the water supply driver 20 to close the hot and cold water valve 22*a*, 22*b* and stop each water supply into the wash tub. Control is then passed to control block 200 where clothes are washed under the washing mode.

In control block 210, an inquiry is made to determine if the water volume has inflowed until a third target level Ht is reached to enter the washing mode. If this volume has not yet reached the third water level Ht, control is passed to control block 215. The second target temperature Tj and the third target temperature Tk are read in control block 215. Control is then passed to control block 217. In this embodiment the second and third target temperatures Ti, Tk are set as 36° C., 40° C. A present temperature t3 of the mixed water contained in the wash tub 27 is read through the temperature detector 25 in control block 217, and control is then passed to control block 220.

In control block 220, the present temperature t3 of the mixed water is compared with the second target temperature Tj. If the comparison value is positive, control is passed to control block 230, and the water supply driver 20 is operated to open only the hot valve 22*a* and supply the hot water into the wash tub 27 continuously. On the contrary, if the comparison value is negative, control is passed to control block 240, and the present temperature t3 of the mixed water is compared with the third target temperature Tk. If the comparison value is positive control is passed to control block 250, but if the comparison value is negative control is passed to control block 260.

In control block 250 the water supply driver 20 is operated to open the hot and cold valve 22*a*, 22*b* and supply the hot and cold water into the wash tub 27 continuously. Further, in control block 260, the water supply driver 20 is operated to open only the cold valve 22*b* and supply the cold water into the wash tub 27 continuously. Control finished in any one among control blocks 230,250 and 260 is fedback to control block 210, respectively. If the water level contained in the wash tub 27 reaches the third target water level Ht, control is passed to control block 190 which operates the water supply driver 20 to close the hot and cold water valves 22*a*, 22*b* and stops each water supply into the wash tub. Control is then passed to control block 200 where clothes are washed under the washing mode.

According to the present invention as described above, since only the cold water is supplied into the wash tub having clothes in a predetermined water level at the onset of the water supply mode and then the mixed water comprised of the cold and hot water is supplied into the wash tub, the damage of clothes owing to the hot water supplied at the onset of the water supply mode is prevented.

Further, since the sensor for detecting the temperature of the water supplied into the wash tub is disposed on the lower part of the wash tub, measuring the substantial temperature of the hot and cold water accurately is effective.

What is claimed:

1. A method for maintaining a set temperature of wash water of clothes washer, said method comprising steps of:

supplying first cold water into a wash tub;

measuring supply time of said first cold water until the wash tub is filled with the first cold water up to a first target level of said first cold water;

measuring temperature of said cold water contained in said wash tub;

supplying hot water and second cold water in said wash tub containing said first cold water;

measuring supply time of said hot water and said second cold water until the wash tub is filled with said hot water and said second cold water up to a second target level of said hot water and said second cold water;

measuring temperature of mixed water being comprised of said hot water and said first and second cold water contained in said wash tub; and comparing temperature of said hot waters which is calculated based on the following four values—supply time of said first cold water, temperature of said first cold water, supply time of said hot water and said second cold water, and temperature of said mixed water—with a predetermined temperature, and controlling a valve for said cold water and a valve for said hot water.

2. The method for maintaining a set temperature of wash water of clothes washer according to claim 1, wherein the measuring step for said supply time of said first cold water comprises steps of:

determining whether the wash tub is filled with said first cold water up to said first target level by a water level detector;

stopping supply of said first cold water when said first cold water reaches said first target level and measuring said supply time of said first cold water; and repeating from said step of supplying first cold water when said first cold water is not yet reached said first target level.

3. The method for maintaining a set temperature of wash water of clothes washer according to claim 1, wherein the step of measuring supply time of said hot water and said second cold water comprises steps of:

determining whether the wash tub is filled with said hot water and said second water up to said second target level by the water level detector;

measuring supply time of said mixed water until the stoppage of the supply of the hot water and the second cold water from the start of the supply of the hot water and the second cold water when said hot water and said second cold water reach said second target level; and repeating from said step of supplying said hot water and said second cold water when said hot water and said second cold water are not yet reached said second target level.

4. The method for maintaining a set temperature of wash water of clothes washer according to claim 1, wherein said first target level is the same as said second target level.

5. The method for maintaining a set temperature of wash water of clothes washer according to claim 1, wherein a pulsator is operated for a predetermined time period before measuring temperature of said first cold water and said mixed water, respectively.

6. The method for maintaining a set temperature of wash water of clothes washer according to claim 1, wherein temperature of said hot water is calculated by following equations;

$$P1 = W / T1$$

$$P2 = W / T2 - P1$$

$$= W / T2 - W / T1$$

where, W is volume of wash water for reaching the first target level or the second target level

P1 is pressure of cold water

P2 is pressure of hot water

T1 is supply time for first cold water

T2 is supply time for hot water and second cold water $$Qcold=T1*P1+T2*P1$$

$$Qhot=T2*P2$$

where, Qcold is sum of volume of cold water in T1 and T2

Qhot is volume of hot water in T2

$$t1*Ocold+y*Qhot=t2*(Qcold+Qhot)$$

where, t1 is temperature of first cold water t2 is temperature of mixed (hot, first and second cold) water y is temperature of hot water.

7. The method for maintaining a set temperature of wash water of clothes washer according to claim 1, wherein the controlling step for a cold water valve and a hot water valve comprises a step of opening fully said cold water valve or said hot water valve when calculated temperature of said hot water is higher than predetermined temperature, and a step of opening fully said cold water valve or said hot water valve or both water valves when calculated temperature of said hot water is lower than the predetermined temperature.

* * * * *